United States Patent [19]

Sindlinger

[11] Patent Number: 4,572,986

[45] Date of Patent: Feb. 25, 1986

[54] CIRCUIT BREAKER WITH THIN-WALLED BULB

[75] Inventor: Ronald E. Sindlinger, Muncy, Pa.

[73] Assignee: GTE Products Corporation, Stamford, Conn.

[21] Appl. No.: 600,238

[22] Filed: Apr. 16, 1984

[51] Int. Cl.[4] ..... H05B 41/18

[52] U.S. Cl. ..... 315/74; 315/73; 315/106; 315/107; 337/27

[58] Field of Search ..... 315/73, 74, 106, 107; 337/27, 25, 23, 22

[56] References Cited

U.S. PATENT DOCUMENTS

| | | | |
|---|---|---|---|
| 4,052,687 | 10/1977 | Kimball et al. | 337/25 |
| 4,097,779 | 6/1978 | Latassa | 315/106 |
| 4,114,968 | 9/1978 | Latassa | 445/6 |
| 4,156,831 | 5/1979 | Cassidy et al. | 315/106 |
| 4,171,519 | 10/1979 | Cassidy et al. | 337/25 |
| 4,510,418 | 4/1985 | Anderson, Jr. et al. | 315/73 |

*Primary Examiner*—David K. Moore
*Assistant Examiner*—Vincent DeLuca
*Attorney, Agent, or Firm*—Carlo S. Bessone; Thomas H. Buffton

[57] ABSTRACT

A rapid-start fluorescent lamp includes a pair of spaced electrodes within an envelope having a fill gas and a phosphor-covered inner wall surface with a circuit breaker having a glass bulb with a wall thickness in the range of about 0.016 to 0.018 inch positioned within the fluorescent lamp.

7 Claims, 1 Drawing Figure

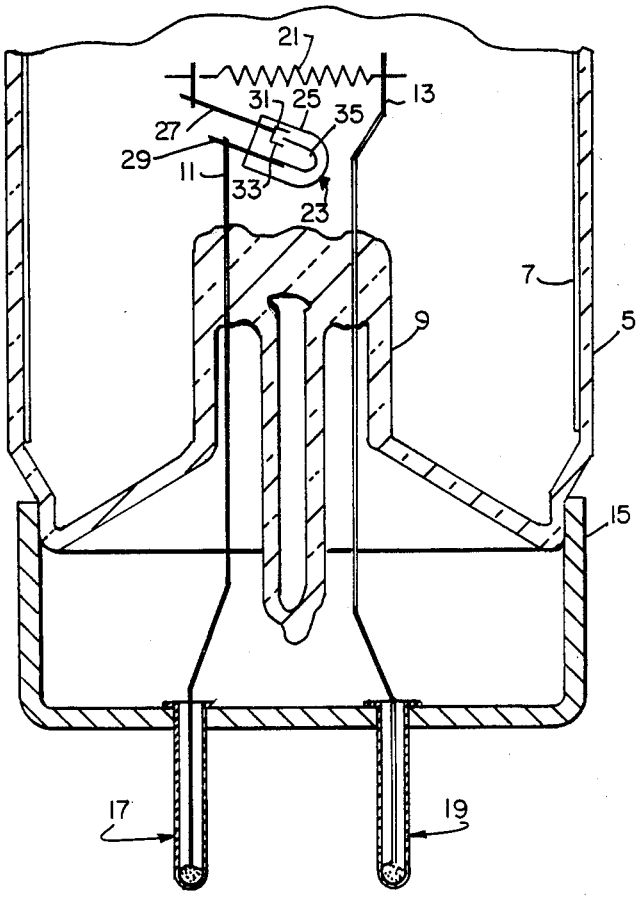
21
13
31
25
35
27
29
11
33
23
7
9
5
15
17
19

CIRCUIT BREAKER WITH THIN-WALLED BULB

CROSS REFERENCE TO OTHER APPLICATIONS:

The following co-pending applications relate to rapid-start fluorescent lamps and more particularly to rapid-start fluorescent lamps employing thermally-sensitive bi-metal circuit breakers: U.S. Ser. Nos. 520,866; 747,689, a continuation of 520,861 now abandoned; 706,912 a continuation of Ser. No. 520,863 now abandoned. 520,862; 582,672 and 582,673.

TECHNICAL FIELD;

This invention relates to rapid-start fluorescent lamps employing thermally-sensitive bi-metal circuit breakers and more particularly to thermally-sensitive bi-metal circuit breakers employing a glass bulb having a relatively thin wall.

BACKGROUND ART;

Generally, the two common forms of fluorescent lamps are the so-called "preheat" type and the "rapid-start" type. The preheat type of fluorescent lamp has heater current flow therethrough during lamp ignition and thereafter a voltage-sensitive starter, external of the lamp, opens and discontinues the above-mentioned heater current flow. However the "rapid-start" type of fluorescent lamp normally has current flow through each electrode not only during ignition but also during the operation period of the lamp. Thus, it can readily be seen that this continuous flow of heater current during operation of the rapid-start lamp is a cause for power loss in the system and an obvious and undesired cause for reduced operational efficiency.

In an effort to improve the energy efficiency of rapid-start fluorescent lamps, numerous suggestions and structural configurations have been suggested. For example, U.S. Pat. Nos. 4,052,687; 4,097,779; 4,114,968; 4,156,831; and 4,171,519 all of which are assigned to the assignee of the present application, provide numerous configurations for enhancing the operation of rapid-start fluorescent lamps. Primarily, each of the above-listed patents relates to rapid-start fluorescent lamps or bi-metal type circuit breakers for fluorescent lamps whereby heater current flow is discontinued during lamp operation.

Although each one of the above-listed structures and techniques enhances and provides numerous advantages over prior known configurations and processes, it has been found that problems still remain. More specifically, it has been found that the normal glass tubing, tubing having a wall thickness in the range of about 0.025 to 0.035-inch, ordinarily employed as the bulb for circuit breakers suited to rapid-start fluorescent lamps leaves much to be desired. For example, it has been found that an excessive amount of heat is required to form glass into a bulb when the glass has a wall thickness of about 0.025 to 0.035-inch. As a result of this heat, the lead wires and bi-metal strip associated with the thermally sensitive bi-metal switch type circuit breaker tend to undesirably oxidize. Also, a relatively large sealing capacity is required and an excessive amount of flushing gas must be employed in an effort to reduce the oxide formation on the electrical leads and bi-metal switch components, when glass having a relatively thick wall thickness is utilized.

OBJECTS AND SUMMARY OF THE INVENTION

An object of the present invention is to overcome the disadvantages of the prior art. Another object of the invention is to provide an enhanced rapid-start fluorescent lamp. Still another object of the invention is to provide a better thermally-sensitive bi-metal circuit breaker. A further object of the invention is to provide an enhanced circuit breaker having components adapted to a reduction in component and manufacturing costs.

These and other objects, advantages and capabilities are achieved in one aspect of the invention by a rapid-start fluorescent lamp having an envelope with a phosphor-coated inner wall surface, a fill gas and a pair of electrodes within the envelope with a pair of electrical leads for each one of the pairs of electrodes wherein the electrical leads are sealed into and pass through the envelope with one lead connected to one of the electrodes and the other lead connected to the electrode by way of a circuit breaker having a thermally sensitive switch connected to a pair of electrical conductors sealed into and passing through a glass bulb having a wall thickness in the range of about 0.016 to 0.018-inch.

In another aspect of the invention, a circuit breaker suitable for use in a rapid-start fluorescent lamp is provided wherein a thermally sensitive bi-metal switch is connected to a pair of electrical conductors which are sealed into and pass through a glass bulb having a wall thickness in the range of about 0.016 to 0.018-inch.

BRIEF DESCRIPTION OF THE DRAWINGS

The sole FIGURE is an embodiment of the invention in the form an an elevational view, partly in section, of one end of a rapid-start fluorescent lamp employing a circuit breaker with a thin-walled bulb.

BEST MODE FOR CARRYING OUT THE INVENTION

For a better understanding of the present invention, together with other and further objects, advantages, and capabilities thereof, reference is made to the following disclosure and appended claims taken in conjunction with the above-described drawing.

Referring to the drawing, a rapid-start fluorescent lamp includes an elongated glass envelope 5 having a coating of phosphor 7 on the inner wall surface of the envelope 5. A glass stem member 9 is sealed into the end of the envelope 5 and a pair of electrical leads 11 and 13 preferably of nickel-plated dumet, are sealed into and pass through the stem member 9. An end cap 15 is telescoped over and attached to the glass envelope 5 and a pair of pins 17 and 19 are affixed to the end cap 15 and to the electrical leads 11 and 13 to provide electrical connection to an external source (not shown). Also, the envelope 5 has a fill gas therein selected from the group consisting of argon, krypton, neon, helium and combinations thereof.

An electrode 21 is located within the envelope 5 and has opposite ends thereof connected to the electrical leads 11 and 13. Thus, the longitudinal axis of the electrode 21 is in a direction substantially normal to the direction of the electrical leads 11 and 13. Moreover, this electrode 21 is frequently referred to as a filament or cathode and of a well known type used in rapid-start fluorescent lamps and usually includes a tungsten coil having a coating thereon in the form of alkaline earth oxides which are applied in the form of carbonates and processed to provide oxides.

Disposed within the envelope 5 is a thermally-sensitive bi-metal circuit breaker 23. The circuit breaker 23 is preferably in the form of a glass bottle or bulb 25. a pair of electrical conductors 27 and 29 are sealed into and pass through the glass bulb 25 with one of the electrical conductors 27 connected to the electrical lead 11 and the other electrical conductor 29 connected to the electrode 21.

Referring more specifically to the circuit breaker 23, one of the electrical conductors 27 may be formed in a U-shaped configuration having first and second up-standing leg members 31 and 33. Also, a straight member 35, formed of thermally-sensitive bi-metal material, is affixed to the other electrical conductor 29 sealed into the envelope 25. Moreover, the straight member 35 extends to a location intermediate the up-standing leg members 31 and 33.

The thermally-sensitive bi-metal straight member 35 is formed to electrically contact one of the up-standing leg members 31 at a time when the bottle or bulb is at an ambient temperature such as a temperature of about 25° C. As the temperature of the bottle or bulb 25 is raised to a given range of temperatures, about 140° to 180° C. for a 40-watt fluorescent lamp for example, the electrical contact between the straight member 35 and the U-shaped configuration is no longer present. Thereafter, raising the temperature of the bulb higher than the previously-mentioned given range of temperature, to about 300° C. for instance, causes the straight member 35 to electrically contact the other up-standing leg member 33 of the U-shaped configuration. Preferably, the thermally-sensitive bimetal switch has a normally-open (N/O) condition for a bulb temperature in the range of about 75° to 300° C. Moreover, other thermally sensitive bi-metal switch configuration are obviously suitable for use in the above-described rapid-start fluorescent lamp.

Importantly, the glass bulb or bottle 25 of the circuit breaker 23 is a wall thickness in the range of about 0.016 to 0.018 inch, as compared with the usual 0.025 to 0.035 inch wall thickness of normally available glass for bulbs. Accordingly, the heat necessary to seal the relatively thin-walled bulb 25 is greatly reduced. As a result of this reduced sealing heat, oxide formation on the electrical conductors 27 and 29 and on the bi-metal material 35 is reduced. Moreover, the reduction in oxide formation is accompanied by reduction in the sealing fire capacity and the amount of flushing gas required.

Additionally, the speed of operation of the circuit breaker 23 is increased due to the faster heating and cooling of the bulb 25 because of the reduced wall thickness and mass. Thus, reduced material and manufacturing costs as well as enhanced and improved operation are achieved by the introduction of a bulb 25 formed of thin-walled glass.

While there have been shown and described what is at present considered the preferred embodiments of the invention, it will be obvious to those skilled in the art that various changes and modifications may be made therein without departing from the invention as defined by the appended claims.

I claim:

1. A rapid-start fluorescent lamp comprising:

a glass envelope having a phosphor-coated inner wall surface;

a low pressure fill gas within said glass envelope;

a pair of spaced electrodes positioned within said envelope;

a pair of electrical leads for each of said pair of spaced electrodes sealed into and passing through said envelope with at least one lead of one of said pair of electrical leads connected to one of said pair of spaced electrodes; and having a circuit breaker positioned within said envelope and a pair of electrical conductors coupling the other lead of said one pair of electrical leads to said electrode, said circuit breaker having a glass bulb with said pair of electrical conductors sealed into and passing therethrough, a thermally sensitive bi-metal switch within said glass bulb and connected to said pair of electrical conductors, and said glass bulb having a wall thickness in the range of about 0.016 to 0.018 inch.

2. The rapid-start fluorescent lamp of claim 1 wherein said fluorescent lamp is a 40-watt fluorescent lamp and said thermally-sensitive bi-metal switch of said circuit breaker is in a normally open (N/O) condition at a bulb temperature in the range of about 140° to 180° C.

3. The rapid-start fluorescent lamp of claim 1 wherein said thermally sensitive bi-metal switch of said circuit breaker has a normally-open (N/O) condition for a bulb temperature in the range of about 75° to 300° C.

4. The rapid-start fluorescent lamp of claim 1 wherein said glass bulb of said circuit breaker is hermetically sealed.

5. A circuit breaker formed for utilization in a rapid-start fluorescent lamp comprising:

a thermally-sensitive bi-metal switch having normally-open (N/O) condition for a given range of temperature;

a pair of electrical conductors connected to said bi-metal switch; and a glass bulb enclosing said bi-metal switch and sealed to said electrical conductors with said bulb having a thickness in the range of about 0.016 to 0.018 inch.

6. a circuit breaker of Claim 5 wherein said given range of temperature for said N/O condition of said thermally sensitive bi-metal switch is a bulb temperature in the range of about 75° to 300° C.

7. The circuit breaker of claim 5 wherein said fluorescent lamps is a 40-watt fluorescent lamp and said given range of temperature for said N/O condition of said thermally sensitive bi-metal switch is a bulb temperature in the range of about 140° to 180° C.

* * * * *